US012185825B2

(12) United States Patent
Vann

(10) Patent No.: US 12,185,825 B2
(45) Date of Patent: Jan. 7, 2025

(54) COLLAPSIBLE SHOT GLASS

(71) Applicant: Bradley Vann, Jacksonville, FL (US)

(72) Inventor: Bradley Vann, Jacksonville, FL (US)

( * ) Notice: Subject to any disclaimer, the term of this patent is extended or adjusted under 35 U.S.C. 154(b) by 63 days.

(21) Appl. No.: 18/201,282

(22) Filed: May 24, 2023

(65) Prior Publication Data

US 2024/0389739 A1 Nov. 28, 2024

(51) Int. Cl.
*A45F 3/20* (2006.01)

(52) U.S. Cl.
CPC ..... *A45F 3/20* (2013.01)

(58) Field of Classification Search
CPC ... A45F 3/20; A45F 2003/205; B65D 21/086; B65D 1/22; B65D 7/22; B65D 7/24; B65D 7/30; B65D 9/12; B65D 9/22; B65D 11/18; B65D 1/265; B65D 81/3865
See application file for complete search history.

(56) References Cited

U.S. PATENT DOCUMENTS 9,221,582 B2 * 12/2015 Wheeler ..... B65D 21/086
2013/0032592 A1 * 2/2013 Lee ..... B65D 21/086 220/8
2013/0270264 A1 * 10/2013 Suljak ..... B65D 25/2811 220/4.03
2013/0277364 A1 * 10/2013 Kusuma ..... A45F 3/20 220/8
2013/0319915 A1 * 12/2013 Gellibolian ..... C02F 1/002 210/87
2015/0041478 A1 * 2/2015 Abrams ..... A47J 41/0022 220/592.16
2017/0253363 A1 * 9/2017 Feeley ..... A47G 19/02
2018/0194517 A1 * 7/2018 Brooks ..... B65D 81/3865
2020/0305619 A1 * 10/2020 Tsui ..... B65D 1/0292
2022/0135294 A1 * 5/2022 Peng ..... B65D 47/0871 220/203.01
2023/0018909 A1 * 1/2023 Harris ..... B65D 43/0212

* cited by examiner

*Primary Examiner* — Kareen K Thomas
(74) *Attorney, Agent, or Firm* — Lawrence J. Gibney

(57) ABSTRACT

A shot glass is designed to store a small quantity of a fluid—normally alcohol—for rapid consumption. A collapsible version of a shot glass is intended to be carried in a person's pants or purse easily and effectively. The shot glass should be cleaned periodically and will be made from semi-rigid material and can be hand washed or placed in a dishwasher.

2 Claims, 6 Drawing Sheets

COLLAPSIBLE SHOT GLASS

BACKGROUND OF THE INVENTION

A. Field of the Invention

This device relates primarily to the field of entertainment and is a collapsible shot glass. The shot glass itself will be constructed of one piece with a slightly tapered surface. Additionally, it will have a way to put into a pair of pants for ease of convenience.

The individual will be able to collapse the shot glass and put it in a pocket. When the device is to be used, the person opens the shot glass for its intended use: a container to dispense a small amount of alcohol. In this application the shot glass is collapsible, and it is contemplated that it will be made from silicone material or other elastic material, so that it is somewhat flexible, but the device should also be somewhat semi rigid.

A lid will be used to cover the device. In this design the device is designed to be washable, preferably by hand, but also maybe washed in the dishwasher.

B. Prior Art

Collapsible shot glasses or collapsible receptacles can be found in the prior art and such an example can be found at Abrams, U.S. Pat. No. 9,119,507. The Abrams references a collapsible travel tumbler. However, it does not have a specific lid that is placed over the top of it. Another prior art reference can be found in Abrams U.S. Pat. No. 9,492,033, which is also a similar receptacle to the prior Abrams reference, but again does not have a lid, which is important to distinguish current application from these prior art references.

Another prior art reference can be found at Miksovsky, U.S. Pat. No. 8,887,942. This references a collapsible cup assembly with lid. However, the lid or covering in this case is substantially different than the lid or cover as contemplated by the current device.

Additionally, Perlman U.S. Pat. No. 8,556,099 is a collapsible cup, but it does not have a lid or cover.

These are some of the representative examples that can be found in the prior art. None of the prior art references claim all the features of this current device.

BRIEF SUMMARY OF THE INVENTION

This is a collapsible shot glass. Shot glasses, of course, come in many different shapes and sizes, bend, and one purpose is to be able to pour a defined quantity of alcohol, typically, for personal enjoyment. This is a device that will collapse so it will have the general capacity to store the amount of alcohol in a typical shot glass but will also have a feature to collapse so that the item can be easily stored in someone's back pocket or front pant. It is designed to be portable and it is designed to be machine washable. It would likely be made of elastic material, such as a silicone or a plastic that can fold.

The device will have a defined structure with a tapered body. On the top of the tapered body will be a ring, and on the ring will be placed a lid, which is hinged at one end and a handle at the other. The handle can also be used to put around a key ring. Near the handle will be a latch that will allow the device to be secured to the top surface of the device.

NUMBERING REFERENCE

Figure 1:
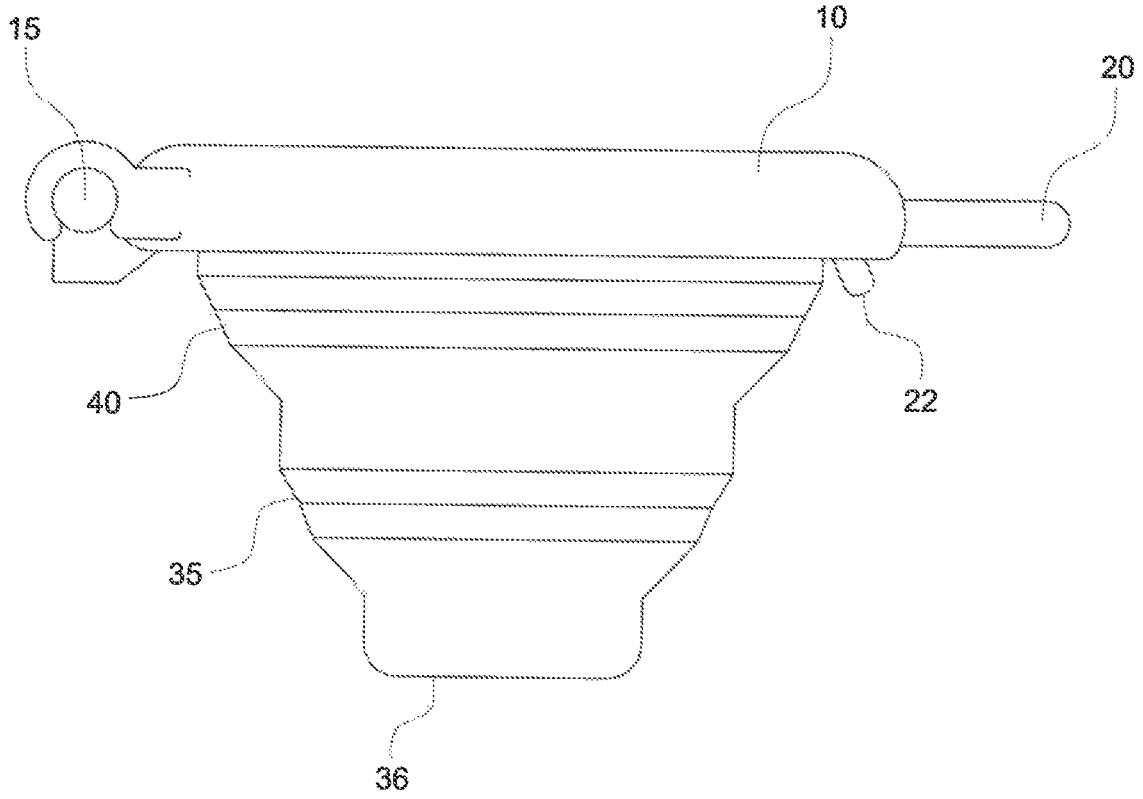
FIG. 1—The front view of the shot glass in the expanded form.
Figure 2:
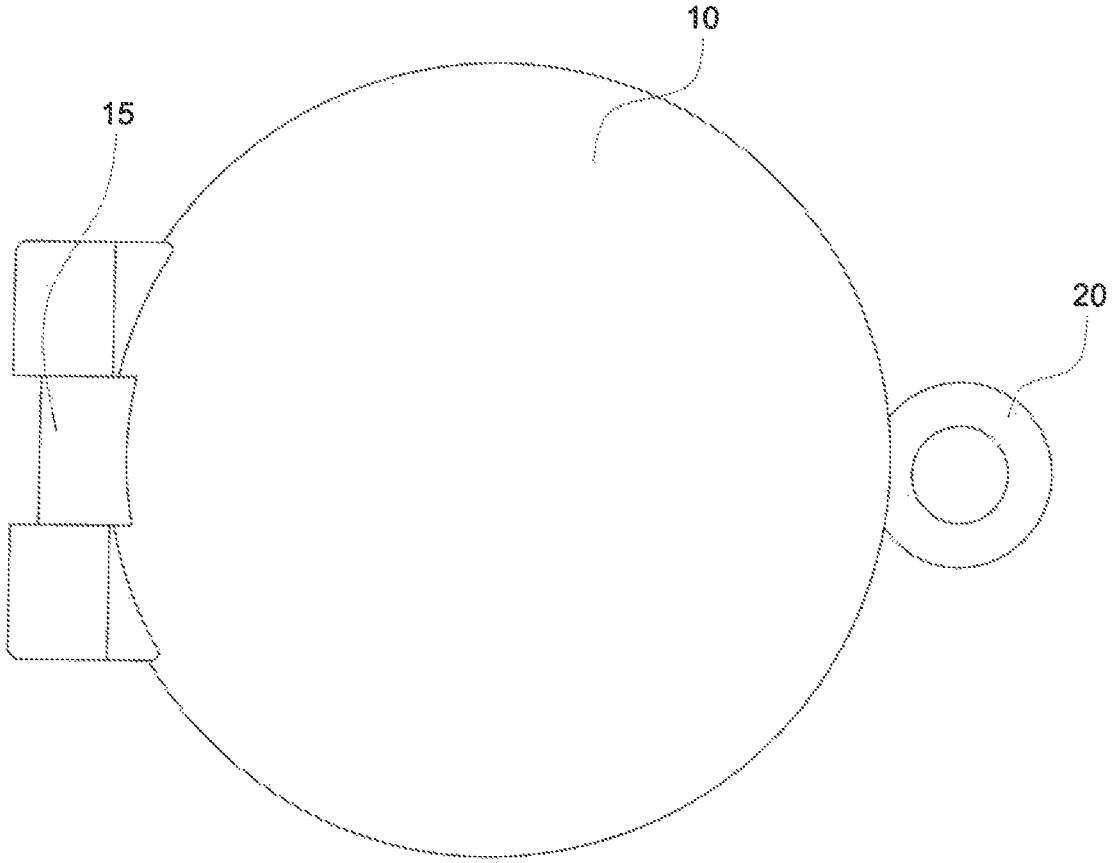
FIG. 2—Top view of the shot glass depicting a lid.
Figure 3:
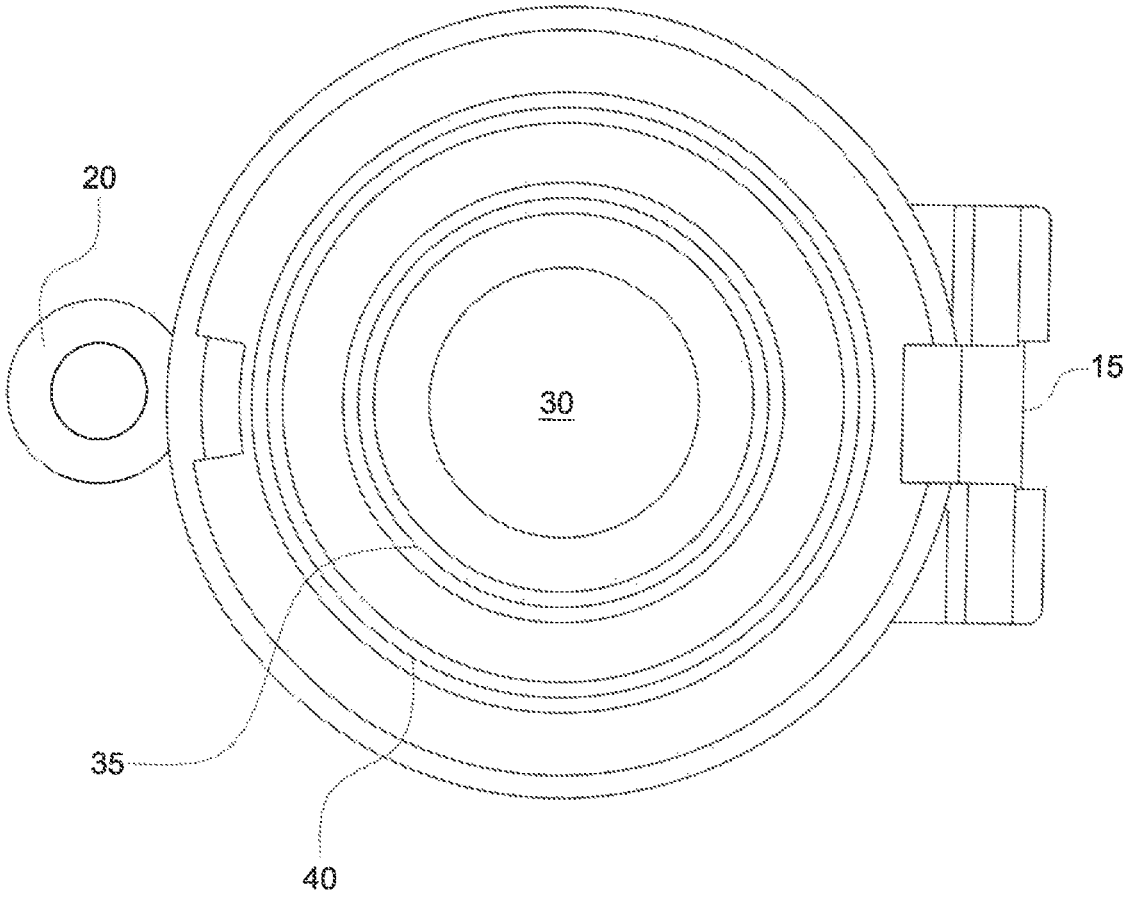
FIG. 3—Bottom view of the device, showing the device collapsed.
Figure 4:
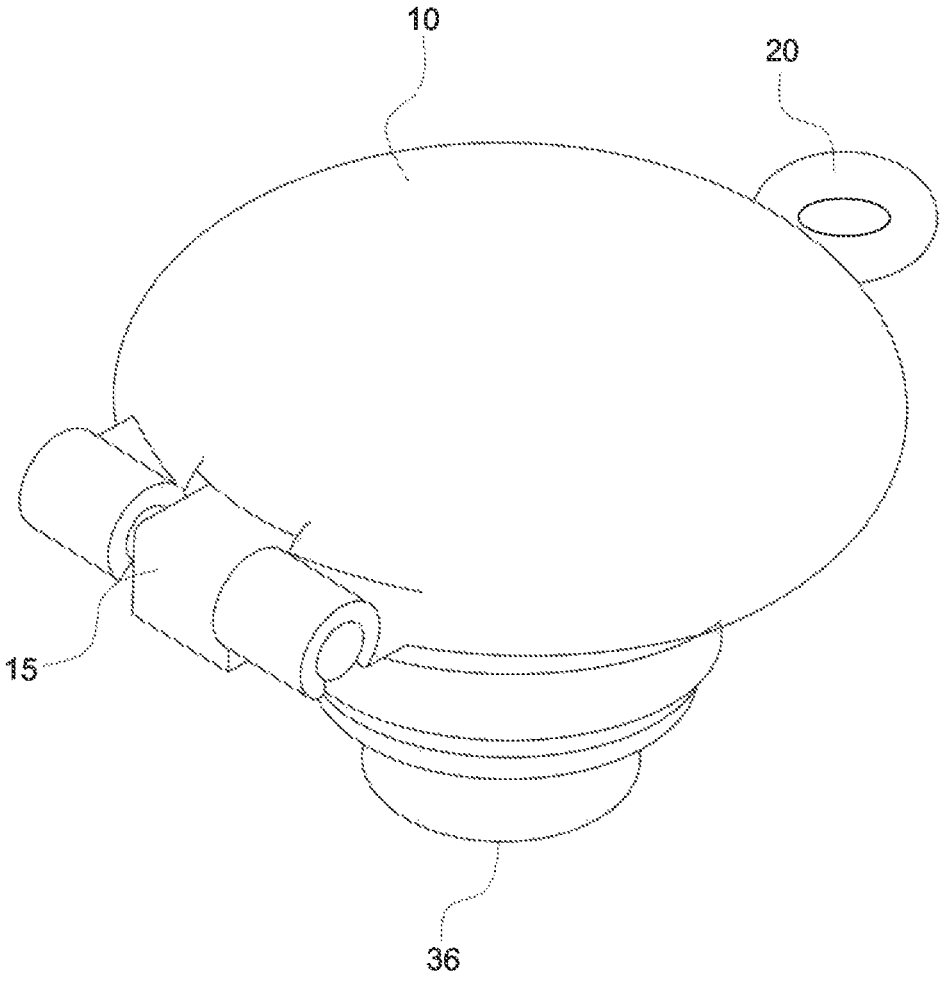
FIG. 4—Bisymmetric view of the shot glass in the expanded form.
Figure 5:
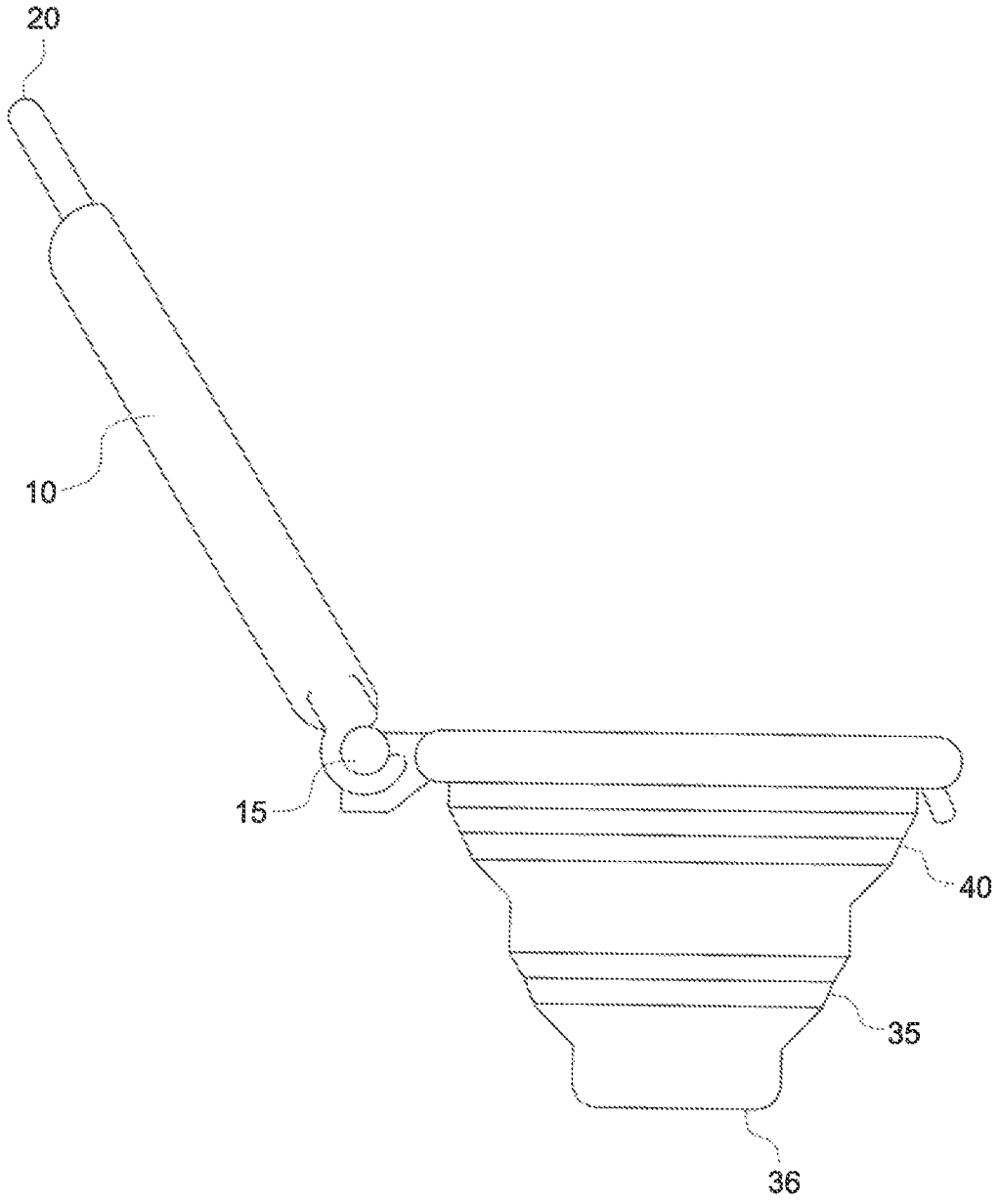
FIG. 5—Front view of the device with the lid open.
Figure 6:
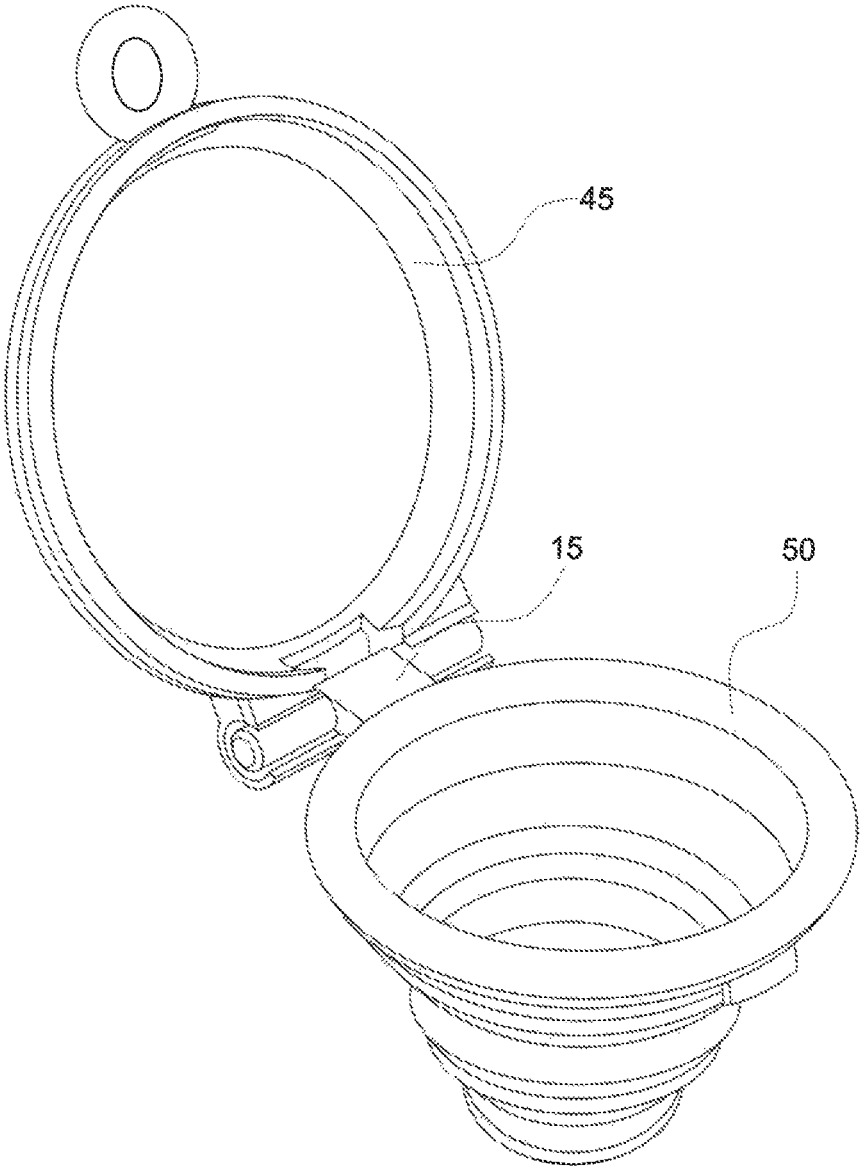
FIG. 6—Isometric view of the device depicting the lid with the gasket and the interior portion of the top lid.

5-Device
10-Lid
15-Hinge
20-Handle
22-Latch
25-Body
30-Bottom
35-First section
40-Second section
45-Gasket
50-Ring on the inside of the top of the device

DETAILED DESCRIPTION OF THE EMBODIMENTS

This device, 5, is a collapsible shot glass which will have a defined body and when fully expanded will hold a predetermined amount of fluid—likely alcohol. The device is likely to hold the approximate quantity of a shot glass that is typically made of glass. A glass shot that is made from glass or other hard material is difficult to transport because it does not fit neatly in a pocket and can also fall and shatter. This shot glass will be made from elastic material that will allow the user to vary the size of the shot glass.

The device will be collapsible in form and will have several sections, including a bottom surface, 30; the top will be open. The device will be tapered from the opening at the top to the bottom surface 30. Between the opening and the bottom surface, a first section, 35, and a second section, 40 are provided. The device 5 can be expanded to variable sizes depending on the preference of an individual user. The capability to vary the size of the shot glass will allow the user to collapse the glass completely or collapse the device 5 partially; the user can moderate the amount of alcohol that is consumed by partially collapsing the device 5. The device 5 is made from a semi-rigid material that will allow the user to expand the item and also allow the user to completely collapse the item.

The top surface will be circular. On the top surface will be a lid, 10. One end of the lid will be a hinge, 15, which is secured to the top surface, which is integral to the device. On the opposite end of the hinge will be a handle, 20, and a latch, 22. The latch 22 will secure the lid 10 to the top surface into and hold the lid 10 in place during periods of non-use. A gasket, 45, on the inside of the lid will surround the lid 10 when the lid is closed to ensure that the device does not leak. A ring 50 on the inside of the lid will mate with the gasket 45 to prevent spills when the lid is closed and latched in place.

The device 5 is made of material that will allow the device to be hand washed or machine washed safely.

An opening in the handle may be provided to attach the device to a lanyard or chain for decorative purposes.

While the embodiments of the invention have been disclosed, certain modifications may be made by those skilled in the art to modify the invention without departing from the spirit of the invention.

The inventor claims:

1. A collapsible shot glass, which is comprised of:
a shot glass,
wherein the shot glass has a predetermined shape,
wherein the shot glass is tapered,
wherein sections are provided on the shot glass,
wherein the shot glass is made from an elastic material,
wherein a first section is provided,
wherein a second section is provided,
wherein the sections are collapsible,
said sections can be partially collapsed,
said sections can be fully collapsed,
wherein the shot glass has a bottom surface,
wherein the shot glass is open on one end,
a lid,
wherein the lid covers the top of the shot glass,
wherein the lid is attached to the shot glass,
wherein a gasket is placed on the inside of the lid,
a ring on the top of the lid,
a latch,
wherein the latch enables closure of the lid over the opening,
a hinge,
wherein the hinge is placed on one end of the lid,
wherein the hinge is integral to the shot glass.

2. The collapsible shot glass as described in claim 1 wherein an opening is provided on a handle.

* * * * *